United States Patent [19]

Bash

[11] 4,116,286

[45] Sep. 26, 1978

[54] PROBE

[76] Inventor: Clayton W. Bash, P.O. Box 111, Forest, Ohio 45843

[21] Appl. No.: 783,150

[22] Filed: Mar. 31, 1977

[51] Int. Cl.[2] ..... E01N 33/24; E21C 13/00

[52] U.S. Cl. ..... 175/19; 73/85

[58] Field of Search ..... 73/84, 85; 175/19–23, 175/414; 30/366; 85/30; 248/156; 52/155; 294/61

[56] References Cited

U.S. PATENT DOCUMENTS

| | | | |
|---|---|---|---|
| 563,790 | 7/1896 | McGreevey | 294/61 X |
| 1,131,149 | 3/1915 | Martin | 85/30 X |
| 1,436,291 | 11/1922 | Rine | 294/61 X |
| 2,690,925 | 10/1954 | Reis | 294/61 |
| 3,340,653 | 9/1967 | Steeg | 85/30 X |
| 3,722,604 | 3/1973 | Lesher | 175/19 |

*Primary Examiner*—Ernest R. Purser
*Attorney, Agent, or Firm*—Freeman Crampton

[57] ABSTRACT

The combination with an elongate shaft, means in operative engagement with one end of the shaft adapted to apply thrust to the shaft and another means in operative engagement with the mentioned end of the shaft for turning the shaft about its major longitudinal axis, to selectively move the shaft endwise or to rotate the same, together with a lamellate head of a thickness equal or less than a transverse dimension of the shaft, in engagement with and extending beyond the opposite end of the shaft in a plane, that, when the shaft is viewed in elevation, is substantially parallel to the major longitudinal axis and, when the shaft is viewed endwise, is at an angle to such axis; the head having a linearly extending edge and a part each in the plane of head extension, the part projecting away from the mentioned shaft axis to a point beyond the span of a shaft lateral surface and having a shoulder that extends at an angle less than a straight angle to the shaft major longitudinal axis, so that when the head is pressed against a penetrable wall body being sought, the linearly extending edge of the head slits the wall body, allowing passage of the head through the slit to a position, when the shaft is turned about its major longitudinal axis and is moved endwise to remove the shaft, to engage with a portion of the wall body on one side of the slit, thereby to signal the presence and location of the wall body.

2 Claims, 9 Drawing Figures

PROBE

SUMMARY OF INVENTION

The invention relates to the problem of locating bodies, particularly such as underground field drainage or irrigation lines in a farm land area. More particularly, the invention concerns the difficulty of locating the more modern plastic pipe that is currently replacing conventional ceramic tile runs.

The use of the probes to locate drainage or irrigation lines is not new, U.S. Pat. No. 80,504 to RHOADES. The more modern of the prior art is, however, represented by U.S. Pat. Nos. 3.722.604 and 2.742.266 to LESHER and VOEKERDING, respectively. The function of probing and locating was then served by inserting a rod at various trial points in the land area until the rod engaged a tile or a series of tiles in the sought for run. This engagement was signaled by the resistance of belowground ceramic tile to further insertion of the rod.

However, with the introduction of the plastic pipe to replace ceramic tile in such land water systems, it was found that the earlier used probe rod of the prior art would pass through the plastic pipe with little perceptible resistance, giving no signal at all. The need for an equally simple and inexpensive but reliable probing tool became apparent, the provision of which constitutes the purpose of and the invention, an embodiment of which is about to be described.

Figure 5A:
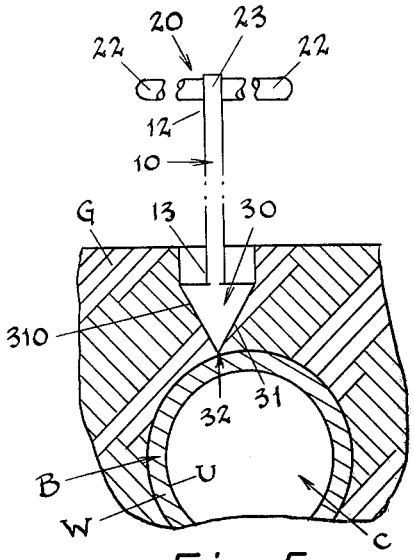
FIG. 5*a* is a view in elevation illustrating diagrammatically a penetration by the probe shown in FIG. 1 into the ground to first engagement of the probe head with a buried body.
Figure 5B:
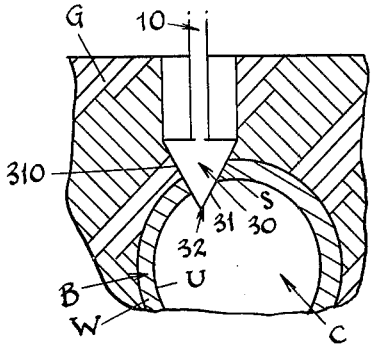
FIG. 5*b* is a similar view to that shown in FIG. 5*a* wherein the probe head is illustrated as having advanced to pierce the buried body of FIG. 5*a;*
Figure 5C:
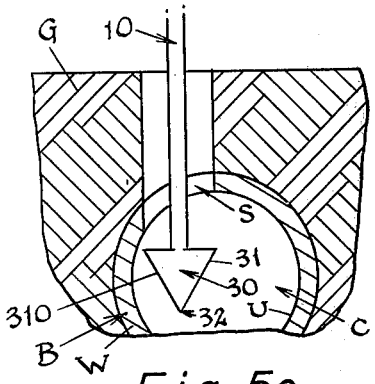
FIG. 5*c* is also a similar view to that shown in FIGS. 5*a* and 5*b,* wherein the probe head is illustrated as having progressed to enter the buried body of FIGS. 5*a* and 5*b;*
Figure 5D:
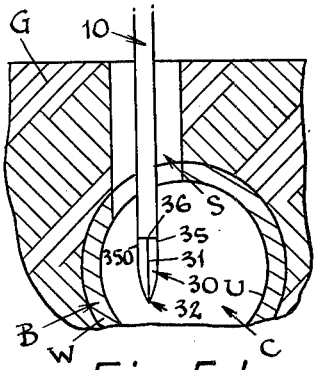
FIG. 5*d* is again a similar view to that shown in FIGS. 5*a,* 5*b* and 5*c* except that the probe head is illustrated as having been turned about its major longitudinal axis.
Figure 5E:
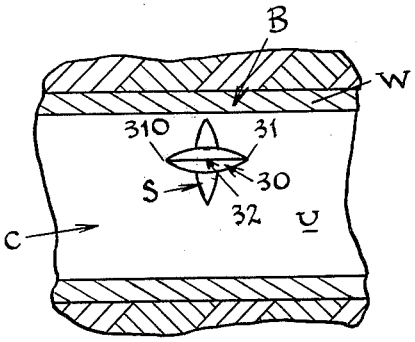
FIG. 5*e* is an end view of the probe head as shown in FIG. 5*d* in a position to engage the interior walls of the buried body and thus to signal the presence of such buried body.

In the sense above indicated, FIGS. 5*a,* 5*b,* 5*c* and 5*d* and 5*e* show a probing and locating sequence in the use of an embodiment of my invention.

DESCRIPTION OF PREFERRED EMBODIMENT

A probe, embodying the features of my invention, in its preferred form, has a rod or shaft 10; means, that may be embodied in a handle 20 associated with the shaft, for separately exerting thrust and torque on the shaft and a lamellate head 30.

The shaft 10 may be of any practical length and is preferably a round rod, in cross section, having a cylindrical lateral surface 11 about its major longitudinal axis, diagrammatically indicated in the drawings by a broken line A.

The means for exerting thrust on the shaft 10 and the other means for exerting torque on the shaft may be jointly embodied in the handle 20 and its parts. The handle 20 is suitably affixed, as by being welded and bonded to the shaft 10 or as shown in the drawings by a bolt strap 21, engaging one end 12 of the shaft 10. The handle 20 has arm parts 22 that provide means by which torque may be applied to the shaft 10. The arms 22 meet at a head portion 23 engaged by strap 21. The strap engaged portion 23 of the handle 20 provides means by which thrust may be applied to the shaft 10.

The lamellate head 30 may be in engagement with the other end 13 of the shaft 10, preferably by being integral with the shaft. It may be made separately of some hardened material and suitably bonded or welded to the shaft end 13. As shown in the accompanying drawings, the head 30 is forged from the shaft stock at the shaft end 13. The head 30 is thin, like a blade, and of a thickness no greater than one of the transverse dimensions of the shaft end 13. This, as shown in FIG. 3 of the accompanying drawings, is of a thickness equal in dimension to, but not greater than, the dimension of the diameter at the shaft end 13.

Figure 4:
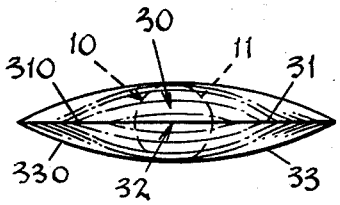
FIG. 4 illustrates an end view of the probe shown in FIG. 3.
Figure 3:
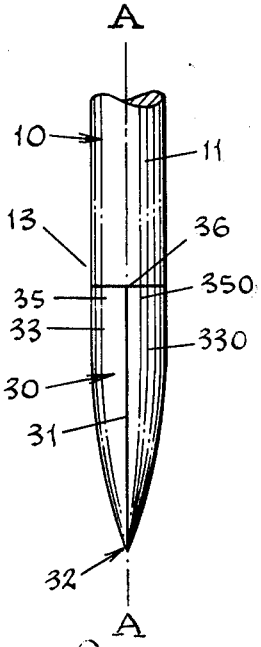
FIG. 3 illustrates an enlarged vertical elevation of the probe shown in FIG. 2 when the same has been rotated about 90° from the position shown in FIG. 2.

The head 30, as also shown in FIG. 3 and FIG. 4 of the accompanying drawings, extends from and beyond the shaft end 13. Such extension of the head 30 is in a plane that, when the shaft 10 is viewed in side elevation, as it is in drawing FIG. 3, such plane of extension is substantially parallel to the major longitudinal axis A of the shaft 10. And, when the shaft is viewed endwise, as it is in drawing FIG. 4, such plane of extension of the head 30 is at an angle, preferably a normal one, to the mentioned longitudinal axis A.

Figure 2:
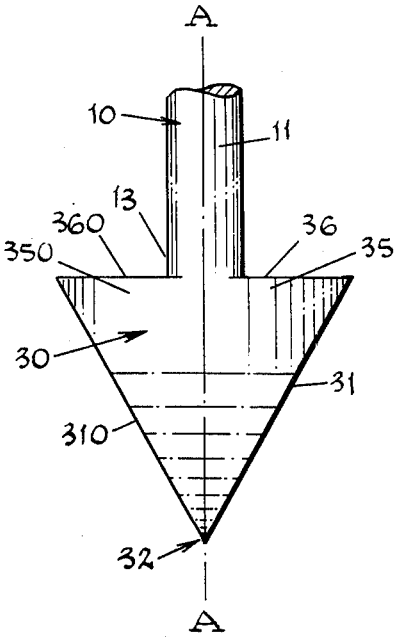
FIG. 2 illustrates an enlarged vertical elevation of the probe shown in FIG. 1.

The lamellate head 30 has, as shown in FIG. 2 of the accompanying drawings, a leading linearly extending edge 31, and, preferably, a second and companion linearly extending edge 310. Each edge 31 and 310 is bevel ground to produce, when the head 30 is moved in one direction by endwise movement of the shaft 10, a cutting action for purposes that will be later explained. The companion leading edges 31 and 310 are preferably positioned on the head 30 to meet each other to form a piercing point or tip 32.

Figure 1:
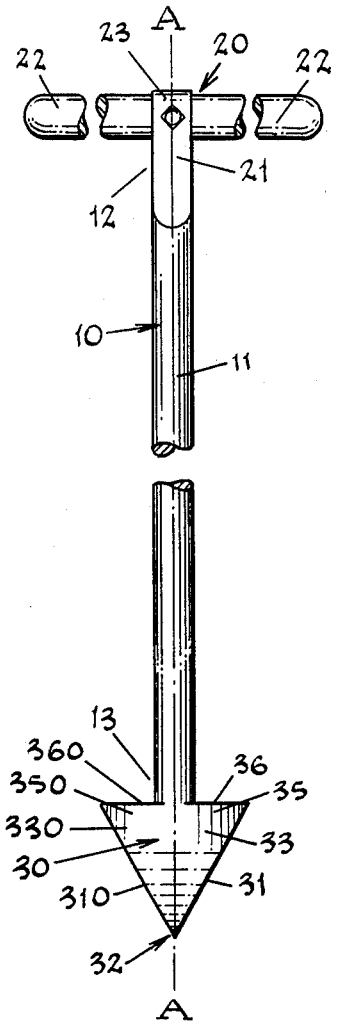
FIG. 1 illustrates a view of a broken vertical elevation of a probe embodying the features of my invention.

In addition, the lamellate head has wing part 33, as shown in FIG. 1 of the drawings, preferably, a pair of similar wing parts 33 and 330. The wing parts are disposed on opposite sides of the shaft longitudinal axis A, extending in the same plane as that in which the head extends. Each wing part 33 and 330 extends in such plane to a point spaced from the longitudinal axis A and beyond the span of the lateral surface of the shaft 10 where it merges with an end of one of the leading edges 31 and 310. This is, as shown in FIGS. 1 and 4 of the accompanying drawings.

Each wing part 33 and 330 has a shoulder 35 and 350, each preferably extending in opposite directions from and at a normal angle to the longitudinal axis A. The shoulders 35 and 350 preferably each have a blunt or flat surface 36 and 360, the better to serve the purposes that will be made apparent herein.

OPERATION

In FIG. 5 of the accompanying drawings, the operation of a probe, embodying my invention in the structure herein described, is diagrammatically illustrated. It is presupposed that it is desired to locate a body B, that may be a plastic field irrigation or drainage pipe, previously buried in and below ground G. The body B has a penetrable wall W that may, in the particular instance, define a conduit chamber C of the body.

The searcher, by applying thrust on the handle head portion 23, inserts the shaft 10, with its end 13 and attached head 30 foremost, into the ground G as shown in diagram *a* of FIG. 5 of the drawings.

Fortunately, in this particular trial and thrust, the head 30 engages the wall W of a body B, as shown in diagram *b* of drawing FIG. 5. Particularly, one or both of the leading edges 31 and 310 of the head 30 engage the wall W. As the searcher continues to apply thrust to the shaft 10, the mentioned leading edges of the head slit the wall W of the body B to produce a slit S. As the thrust continues, a condition shown in diagram *c* of FIG. 5, the head 30 passes through the slit S and in the illustrated instance into the chamber C.

The searcher, in contemplation of testing the probe to determine whether or not the head 30 thereof has indeed penetrated a body wall, turns the shaft 10 through an angle less than 180°, preferably about 90°, as shown in diagram *d* of FIG. 5. The turning of shaft 10 is accomplished by applying limited torque to the shaft 10 as by the handle arm parts 22. The searcher than may attempt to withdraw the probe by applying upward thrust on the head portion 23 of the handle 20.

As the probe is moved upwardly, the wing part shoulders 35 and 350 engage the undersurface U of the body wall W on opposite sides of the slit S. This engagement, shown in the diagram *e* of FIG. 5, is preferably made by the blunt shoulder surfaces 36 and 360 with the wall undersurface U of the body B. Such engagement limits the withdrawal of the probe and thus signals the searcher that body B has been located.

Of course, freeing of the probe may be accomplished by again turning the shaft 10 to locate the head 30 in substantial alignment with the slit S and drawing the probe upwardly.

I claim:

1. In a probe for locating buried plastic field tile, having the combination of an elongate shaft, a handle in engagement with one end of the shaft for imparting thrust and torque to the shaft, and a head in engagement with the other end of the shaft characterized by being a substantially lamellate body of a thickness equal in dimension to one of a dimension that is less than and another that is equal to a transverse dimension of the shaft, the body extending from the shaft end in a plane, which, when the body is viewed edgewise, is between two substantially parallel spaced lines, each on opposite sides of and parallel to the major longitudinal axis of the shaft and substantially coincidental with opposite lateral surfaces of the shaft, and when the body is viewed in plan from a point substantially 90° about the shaft major longitudinal axis from the point of mentioned edgewise view, extends laterally between and from one to the other of a second two substantially parallel spaced lines on opposite sides of and parallel to the major longitudinal axis of the shaft, one of which lines is spaced a greater distance from the major longitudinal axis of the shaft than the distance between such axis and each of the first mentioned two lines;

the body having an end edge in spaced relation to the handle and of less thickness than the body extending linearly substantially in the mentioned plane at an acute angle to the major longitudinal axis of the shaft and a second edge closer to the handle than the first mentioned edge and being of a thickness substantially equal to that of the body and extending in the mentioned plane and substantially normal to the mentioned shaft axis, whereby, through manipulation of the probe handle, the shaft may move the first mentioned edge of the head body to engage and having engaged then to line slit a wall of a sought plastic tile allowing, on further thrust of the probe shaft, passage of the probe head through the slit and into the tile interior and, upon rotation of the shaft less than 180°, to dispose the second mentioned edge of the body to engage wall portions of the plastic tile on one side of the slit and thereby to signal the presence of a tile by the resistance to subsequent testing movement to withdraw the probe shaft.

2. In a probe, as described in claim 1; in which the lamellate body is substantially triangular in perimetric outline;

the first mentioned edge being knife sharp and extending along one side of the triangular perimeter and the second mentioned edge extending along another side of the triangular perimeter adjoining the first mentioned edge side.

* * * * *